US012735979B2

(12) United States Patent
Amur Varadarajan et al.

(10) Patent No.: US 12,735,979 B2
(45) Date of Patent: Sep. 15, 2026

(54) WELLBORE TRIPPING ADVISOR

(71) Applicant: Schlumberger Technology Corporation, Sugar Land, TX (US)

(72) Inventors: Prasanna Amur Varadarajan, Clamart (FR); Nicholas Abolins, Clamart (FR); Ghislain Roguin, Périgny (FR); Maurice Ringer, London (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 367 days.

(21) Appl. No.: 18/520,635

(22) Filed: Nov. 28, 2023

(65) Prior Publication Data

US 2025/0172064 A1 May 29, 2025

(51) Int. Cl.

| | |
|---|---|
| ***E21B 47/06*** | (2012.01) |
| ***E21B 19/00*** | (2006.01) |
| ***E21B 21/08*** | (2006.01) |
| ***E21B 47/08*** | (2012.01) |
| ***G06F 30/28*** | (2020.01) |

(52) U.S. Cl.
CPC ..... *E21B 47/06* (2013.01); *E21B 21/08* (2013.01)

(58) Field of Classification Search
CPC ..... E21B 47/06; E21B 21/08; E21B 19/00; G06F 30/28
USPC ..... 702/6
See application file for complete search history.

(56) References Cited

U.S. PATENT DOCUMENTS

| | | | | |
|---|---|---|---|---|
| 4,566,318 | A * | 1/1986 | Rao | E21B 19/20 73/152.43 |
| 10,570,677 | B2 | 2/2020 | Richardson | |
| 11,021,919 | B2 | 6/2021 | Zhang | |
| 11,326,404 | B2 | 5/2022 | Omrani | |
| 2022/0195819 | A1 * | 6/2022 | Jamison | E21B 47/06 |

FOREIGN PATENT DOCUMENTS

CN 113378344 A 9/2021

OTHER PUBLICATIONS

Lee et al., Development of a trip time for bit exchange simulator for drilling time estimation, Geothermics 71, 2018, pp. 24-33.

* cited by examiner

*Primary Examiner* — Michael P Nghiem
(74) *Attorney, Agent, or Firm* — Jeffrey D. Frantz

(57) ABSTRACT

A method for determining a maximum tripping velocity for tripping a downhole tool string in a wellbore includes obtaining contextual data including wellbore data, tool string data, and drilling fluid data; computing downhole drilling fluid pressures at multiple tool string velocities and accelerations using the obtained contextual data and a wellbore hydraulics model; generating an equivalent circulation density (ECD) contour along a two-dimensional acceleration and velocity parameter space from the computed downhole drilling fluid pressures; and evaluating the ECD contour with at least one of a formation pore pressure or a formation fracture pressure to generate the maximum tripping velocity.

15 Claims, 11 Drawing Sheets

WELLBORE TRIPPING ADVISOR

CROSS REFERENCE TO RELATED APPLICATIONS

None

BACKGROUND

Tripping is an essential activity when operating (e.g., drilling) in a wellbore. Tripping (also referred to as tripping pipe) is commonly defined as the act of pulling a tool string (such as a drill string) out of a wellbore and/or running the tool string back into the wellbore. Common reasons for tripping include starting and/or finishing a section of a wellbore, replacing a worn drill bit, and replacing damaged or malfunctioning tools in the string.

During a tripping operation, the moving tool string acts like a piston and causes fluid pressure changes in the wellbore. While tripping in, the downward movement of the tool string increases the fluid pressure below the string (referred to in the industry as a surge). While tripping out, the upward movement of the tool string decreases fluid pressure below the string (referred to in the industry as a swab). These surge and swab pressures can negatively affect well integrity if the pressure falls below the pore pressure of the formation or rises above the fracture pressure of the formation. For example, wellbore kicks may be more like to occur while tripping out.

Surge and swab effects are generally influenced by multiple variables, including the tripping speed, the geometries of the wellbore and tool string, and various properties of the drilling fluid such as fluid density and fluid viscosity. Surge and swab effects can also be influenced by whether or not the drilling fluid is circulating while tripping. Tripping is commonly performed without drilling fluid circulation, although circulation can sometimes be required. While hydraulic manuals and software can be used to predict surge and swab pressures, there is room for further improvement, for example, to advise safe and timely tripping velocities and accelerations.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Embodiments of this disclosure include a method and system for determining a maximum tripping velocity for tripping a downhole tool string in a wellbore. In one example embodiment, a method includes obtaining contextual data including wellbore data, tool string data, and drilling fluid data; computing downhole drilling fluid pressures at multiple tool string velocities and accelerations using the obtained contextual data and a wellbore hydraulics model; generating an equivalent circulation density (ECD) contour along a two-dimensional acceleration and velocity parameter space from the computed downhole drilling fluid pressures; and evaluating the ECD contour with at least one of a formation pore pressure or a formation fracture pressure to generate the maximum tripping velocity.

Figure 1:
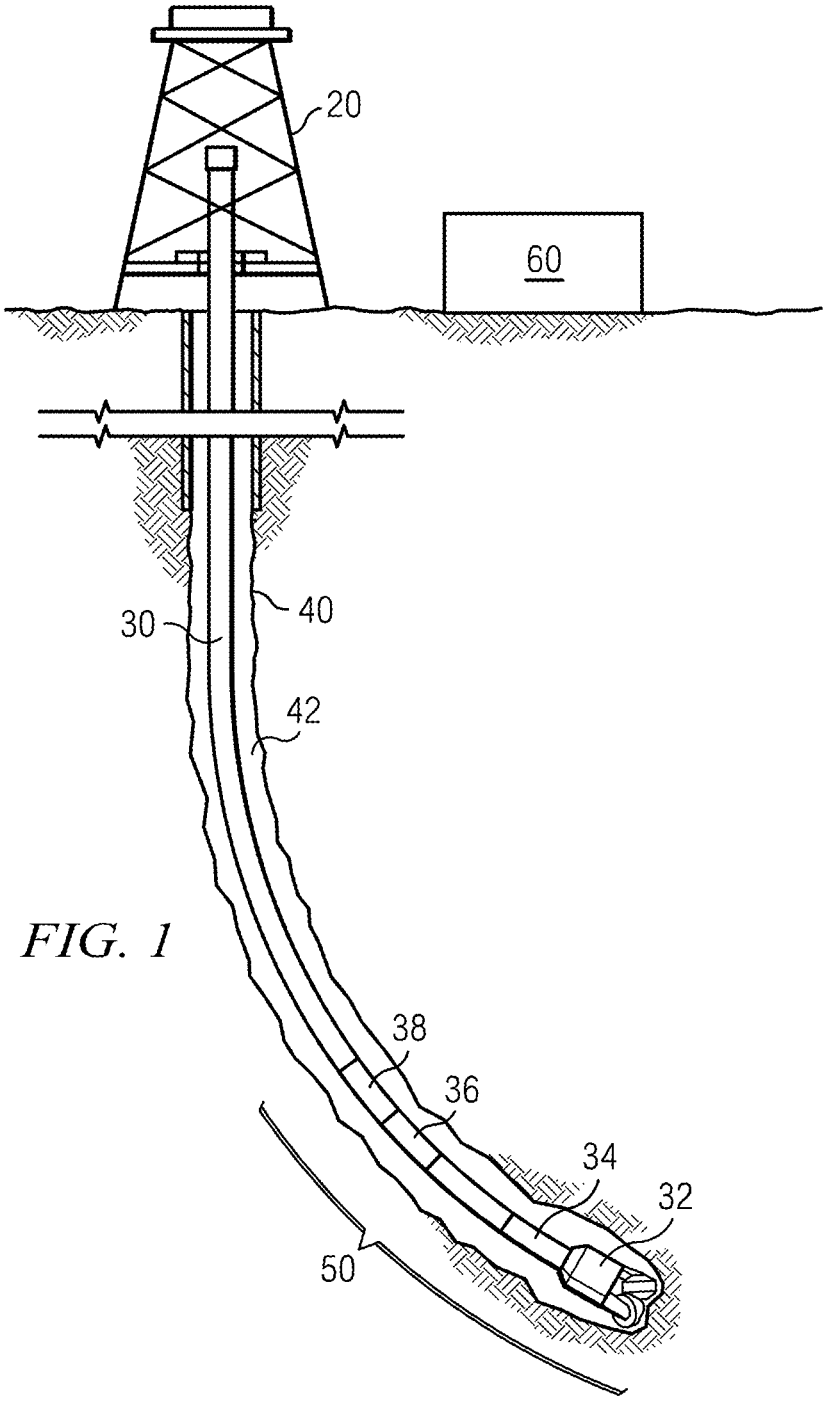
FIG. 1 depicts an example drilling rig including a system for monitoring and/or advising a tool string tripping operation in a wellbore.

FIG. 1 depicts an example drilling rig 20 including a system 60 for monitoring and/or advising a tool string tripping operation in a wellbore. The drilling rig 20 may be positioned over a subterranean formation (not shown) and may be configured for drilling a geothermal well or a hydrocarbon exploration and/or production well. The rig 20 may include, for example, a derrick and a hoisting apparatus (also not shown) for raising and lowering a drill string 30, which, as shown, extends into wellbore 40 and includes a bottom hole assembly 50 that may further include, for example, a drill bit 32, a steering tool 34 (such as a rotary steerable tool), a logging while drilling (LWD) tool 36, and a measurement while drilling (MWD) tool 38. It will be appreciated that the disclosed embodiments are not limited to any particular drill string or BHA configuration or even to tripping a drill string. The disclosed embodiments are equally well suited for tripping substantially any tool string including, for example, a completion string or a production string.

A wellbore 40 may be formed in subsurface formations by rotary drilling or slide drilling in a manner that is well-known to those or ordinary skill in the art (e.g., via well-known directional drilling techniques). For example, the drill string 30 may be rotated at the surface and/or via a downhole deployed mud motor to drill the well. A pump may deliver drilling fluid to the interior of the drill string 30 thereby causing the drilling fluid to flow downwardly through the drill string 30. The drilling fluid exits the drill string 30, e.g., via ports in the drill bit 32, and then circulates upwardly through the annulus 42 between the outside of the drill string 30 and the wall of the wellbore 40. In this known manner, the drilling fluid lubricates the drill bit 32 and carries formation cuttings uphole to the surface. The drilling fluid then commonly flows through a return conduit and solids control equipment to a mud pit (not shown) where it may be recycled. It will be appreciated that the terms drilling fluid and mud are used synonymously herein.

Those of ordinary skill will readily appreciate that from time to time during a drilling operation (or other downhole operation) it may be necessary to trip a drill string (or other tool string) out of and back into the wellbore 40. For example, the drill string may be tripped into a wellbore at the beginning of a drilling operation and tripped back out of the wellbore at the completion of the drilling operation. Moreover, the drill string may be tripped out of the wellbore, for example, to replace a worn drill bit or some other damaged or malfunctioning tool and then tripped back into the wellbore with the new or repaired drill bit or tool. Other tool strings are also commonly tripped into and out of subterranean wellbores. Such tripping is described in more detail below with respect to FIGS. 2A and 2B.

Various sensors (not shown) may be located about the wellsite to collect data (or drilling parameters) related to the drilling operation, such as standpipe pressure, pump pressure, hook load, traveling block height and velocity, surface torque, rotary rpm, among others. The bottom hole assembly (BHA) 50 may also include downhole sensors disposed in the drill bit 32, a steering tool 34, an LWD tool 36, and/or an MWD tool 38 to provide information about downhole conditions, such as wellbore pressure, weight on bit, torque on bit, wellbore heading or attitude (inclination and azimuth), collar rpm, tool temperature, annular temperature, and toolface, among others. These sensors (both uphole and downhole) may be configured to provide data to the system 60 to monitor a tripping operation.

With continued reference to FIG. 1, in example embodiments, the system 60 may advantageously be deployed at the rig site (e.g., in an onsite laboratory or at the rig floor). The disclosed embodiments are, of course, not limited in this regard. The system 60 may include computer hardware and software configured to monitor and/or advise a tool string tripping operation in a wellbore. To perform these functions, the hardware may include one or more processors (e.g., microprocessors) which may be connected to one or more data storage devices (e.g., hard drives or solid state memory). As is known to those of ordinary skill, the processors may be further connected to a network, e.g., to receive the various sensor data from networked sensors) or another computer system. It will be further understood that the disclosed embodiments may include processor executable instructions stored in the data storage device. The executable instructions may be configured, for example, to execute method 100 to provide an advised tripping velocity and tripping acceleration. It will, of course, be understood that the disclosed embodiments are not limited to the use of or the configuration of any particular computer hardware and/or software.

Figure 2A:
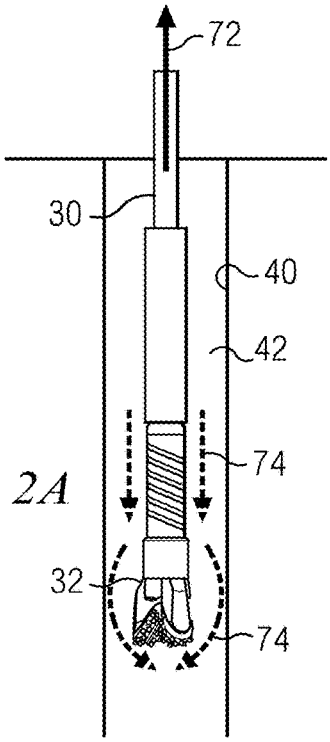
FIGS. 2A and 2B (collectively FIG. 2) schematically depict tripping operations in which a drill string is tripped out of (2A) and tripped into (2B) a wellbore.
Figure 2B:
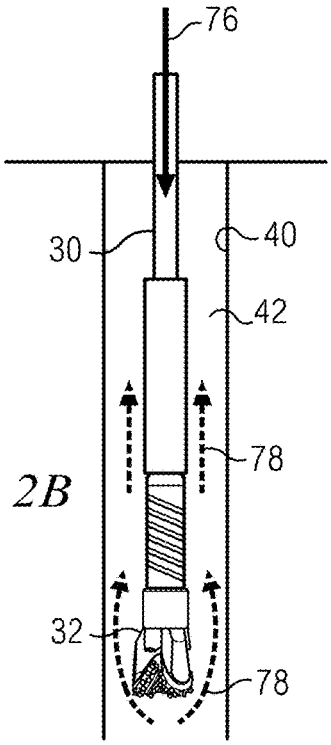

FIGS. 2A and 2B (collectively FIG. 2) schematically depict tripping operations in which a drill string is tripped out of (2A) and tripped into (2B) a wellbore 40. In FIG. 2A, the drill string 30 is pulled uphole 72 and out of the wellbore 40 as it is tripped out. Drilling fluid in the annulus 42 moves downwards (downhole) 74 around the drill bit 32 to replace the volume previously occupied by the string. This upward movement of the string 30 (acting like a piston) results in a decrease in downhole pressure (referred to as swab pressure) that can in turn draw formation fluids into the well. In FIG. 2B, the drill string 30 is pushed downhole 76 into the wellbore 40 as it is tripped in. The fluid in the wellbore 40 is forced to move upwards (uphole) 78 into the annulus 42 to provide volume for the string. The downward movement of the string 30 (acting like a piston) results in an increase in downhole pressure (referred to as surge pressure) that can in turn damage or fracture the formation. It will be appreciated that surge and swab pressures can also vary along the length of the drill string depending on the configuration and local geometry of the string. These local surge and swab pressures, if high or low enough, can cause local formation fracturing (surge) or location suction of formation fluids into the well (swab).

The magnitudes of the surge and swab pressures are generally influenced by multiple variables, including the tripping speed, the geometries of the wellbore and tool string, and various properties of the drilling fluid such as fluid density and fluid viscosity. For example, increasing tripping speed generally increases surge and swab pressure. Likewise, surge and swab pressures generally increase with increasing fluid density and viscosity. Certain downhole tools, such as packers, scrapers, and stabilizers that have small annular clearance can also increase surge and swab pressures.

During many downhole operations, safety protocols often require the downhole pressure to be monitored in real time to ensure that it is maintained within a predefined pressure window. Such pressure monitoring is especially important in managed pressure drilling and underbalanced drilling operations. Pressure monitoring can also be important in off shore operations where heave effects can impact the bottom hole equivalent circulation density. During a tripping operation it is generally not possible to measure the downhole pressure (since the tool string is being tripped in or out of the well). Various software applications are used to model downhole pressure, however, there is room for further improvement.

During tripping (either in or out), the string is commonly tripped stand by stand or joint by joint. For example, when tripping out, the string may be pulled out of the hole (POOH) the length of one stand (e.g., 30 meters), after which the tripped stand is disconnected. The string is then pulled upwards again, after which the next tripped stand is disconnected. And so on until the entire string is removed from the well. This process results in a discontinuous velocity profile. For example, the string may be initially accelerated to an approximate constant velocity after which it is decelerated and stopped before disconnecting the stand (or joint). The disclosed embodiments are intended to account for both the acceleration and velocity of the string while tripping and to advise a driller on appropriate velocity and acceleration ranges for fast and safe tripping.

Figure 3:
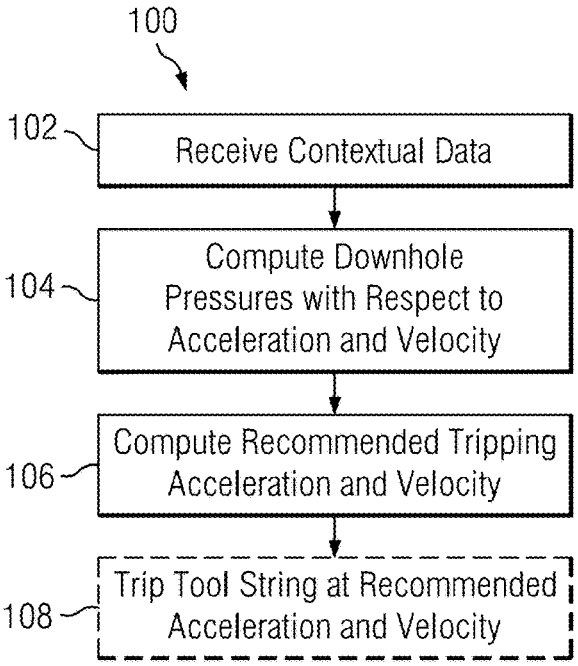
FIG. 3 depicts a flow chart of one example method for advising and/or monitoring a tripping operation.

FIG. 3 depicts a flow chart of one example method 100 for advising and/or monitoring a tripping operation. Method 100 includes receiving static (contextual) and optional dynamic (transient, real-time) data at 102. The static data may include, for example, wellbore/tool string geometry and drilling fluid rheology data. The geometry data may include, for example, the wellbore diameter, diameters of various components in the tool string, etc. The drilling fluid rheology data may include, for example, fluid viscosity, fluid density, and fluid gel strength. The dynamic data may include time series data including real-time inputs of drilling fluid pressure such as standpipe or pump pressure, drilling fluid flow rate, and drill bit depth in the wellbore. The drill bit depth may also be included in the static data indicating a start, finish, or average depth while tripping a stand.

The received data is input into a hydraulic model and evaluated with the model at 104 to compute downhole pressure with respect to the acceleration and velocity of the tool string in the wellbore. The downhole pressure may include for example, downhole surge and swab pressures and/or equivalent circulation density (ECD) in the wellbore. The model may advantageously generate pressure and/or ECD with respect to tool string acceleration and velocity, for example, showing the influence of the acceleration and velocity on the pressures and/or ECD. The model output (e.g., the output pressures and/or ECD) may be compared with known and/or estimated pore and fracture pressures (as well as other formation properties) to compute a recommended tripping acceleration and velocity at 106. The recommended acceleration and velocity may include, for example, maximum acceleration and velocity values or an acceptable range of tripping acceleration and velocity values. The tool string may be optionally tripped below the recommended maxima or in the recommended range at 108 to promote a safe tripping operation.

With further reference to FIG. 3, it will be appreciated that the hydraulic model may be a transient model that advantageously accounts for the acceleration of the tool string and various non-Newtonian fluid effects (such as gelling). For example, the model may be configured to compute wellbore surge and swab pressure and/or ECD from the input static and optional dynamic data with respect to tool string acceleration and velocity. The model may be further configured to receive dynamic pressure, flow rate, depth, and/or temperature data and to update the computed pressure and/or ECD in real time while tripping (e.g., from stand to stand).

In one example embodiment, the model may be a transient hydraulic model that is configured to receive static data and optional real time measurements (dynamic data) of drilling fluid flow rate and depth and to compute drilling fluid parameters (e.g., pressures) along the depth of the well and at the surface (e.g., in the standpipe). In example embodiments, the model may include a one dimensional (1D) compressible isothermal model for mud flow through an area that varies with depth. The model may include flow inside the tool string (e.g., drill pipe) and the wellbore annulus. The modeled flow path may include flow inside a tool string (e.g., drill string and BHA) and then may be coupled to the flow into the wellbore at the end of the tool string (e.g., at the bit) and into the annulus. The model may capture the isothermal flow in the varying area well bore and the drill pipe via changing cross sectional areas along the length of the string and wellbore. In example embodiments, the area may be modeled as a time and space varying function to replicate the physical behavior of the moving tool string.

In certain embodiments, an entire well (or rig) system may be modeled as a coupling between two 1D pipe flow solvers for a single-phase flow with appropriate boundary conditions and coupling between them. Equations for the tool string may be written in the frame of reference of the string since when it accelerates it may be thought of as being in a non-inertial frame of reference. A point model for flow transitions from pipe flow to flowline may be considered for the flow along the bell nipple, open channel flow model based on 1D shallow water equations for the circular flowline along with the conditions for the by-pass. In example embodiments, the model may consider the compressible nature and gel nature of the drilling fluid inside the well and incompressible drilling fluid with gel effects for open channel flow.

As noted above, the hydraulic model may be configured to compute downhole pressure with respect to the acceleration and velocity of the tool string in the wellbore. In one example embodiment, the hydraulic model may account for acceleration and fluid gelling in pipe flow and fluid friction models. For example, conservation of mass and momentum of isothermal fluid flow in the pipe may be expressed as follows with U being the vector of conservative variables of mass and momentum and F the flux functions of the conservative variables and $S_1$ and $S_2$ being the source terms consisting of the hydrostatic terms and the friction and with geometric gradients.

$$\frac{\partial U}{\partial t} + \frac{\partial F}{\partial x} = S_1 + S_2$$

The source terms may be split into two terms where one represents the constant terms with no spatial gradients and the other term with spatial gradients. The components of the vector may be given as follows:

$$U = \begin{bmatrix} \rho \\ \rho u \end{bmatrix},$$

$$F = \begin{bmatrix} \rho u \\ \rho u^2 + p \end{bmatrix},$$

$$S_1 = \begin{bmatrix} M_{in_S} \\ 0 \end{bmatrix},$$

$$S_2 = \begin{bmatrix} M_{in_I} - \frac{\rho}{A}\frac{\partial A}{\partial t} - \frac{\rho u}{A}\frac{\partial A}{\partial x} \\ -sf_i - sf_o - \frac{\rho u}{A}\frac{\partial A}{\partial t} - \frac{\rho u^2}{A}\frac{\partial A}{\partial x} - \rho\left(g\ \sin\vartheta - \frac{dV_p}{dt}\right) - p_n \end{bmatrix}$$

where ρ represents the density of the fluid, u represents the velocity, p represents the pressure, A represents cross sectional area averaged over the cell, g represents the gravitational constant, ϑ represents the inclination of the well with respect to the horizontal, $M_{in(s,I)}$ represents the point source of mass injection, $sf_i$ and $sf_o$ represent are the friction loss terms for both the inside and outside section of the flow domain. The friction factor f may be defined based on the Churchill model and the Gel model for the for the fluid. The speed of the pipe in which the equations are written is $V_p$, where $$\frac{dV_p}{dt}$$

represents the pipe acceleration.

The generic form of the friction term based on the Churchill model may be given as follows:

$$sf_i = \frac{f_i}{2}\rho(u - V_p)|u - V_p|\frac{P_{wi}}{A},$$

-continued $$sf_o = \frac{f_o}{2}\rho\, u|u|\frac{P_{w_o}}{A}$$

$$f_{i/o} = 2\left[\left(\frac{8}{\mathrm{Re}}\right)^{12} + (A+B)^{-1.5}\right]^{1/12},$$

$$Re = \frac{2\rho u^2}{\tau_e},$$

$$\tau_e = \left(\lambda\tau_{max} + k\left(\frac{2|u|}{D_h}\right)^n\right)$$

where Re is the Reynolds number, A is a coefficient that depends on the pipe roughness, pipe diameter and the Reynolds number, B is a coefficient that depends on the Reynolds number, $f_i$ and $f_o$ represent the Churchill coefficients for the inner and outer surfaces of the pipe, $P_{w_i}$ and $P_{w_o}$ represent the wetted perimeter of the interior and outer surfaces of the pipe, λ represents the transient gel parameter, and $\tau_0$, k and n represent the Herschel Buckley parameters defining the rheology of the fluid. The friction losses may be defined for the interior of the pipe/annulus section and for the outer edge of the section. The transient gel parameter may be modeled, for example, as follows:

$$\frac{d\lambda}{dt} = \begin{cases} -\beta\lambda\dfrac{u\,dx}{A} & \text{if } \dfrac{|u|}{D_h} > 0 \\ -\alpha(\lambda - 1) & \text{if } \dfrac{|u|}{D_h} = 0 \end{cases}$$

The value of λ is constrained between 1 and an equilibrium value ($\lambda_{equilibrium}$) and α, β represent the gel breaking and gel forming coefficients. The value of 1 is used when the mud is fully gelled and the value of ($\lambda_{equilibrium}$) is when the gel is completely broken. This corresponds to the value of yield stress that is measured by the rheometer. Since real time measurement of the gel parameters are difficult, they may be estimated by calibrating it with pump start stop scenario.

Figure 4:
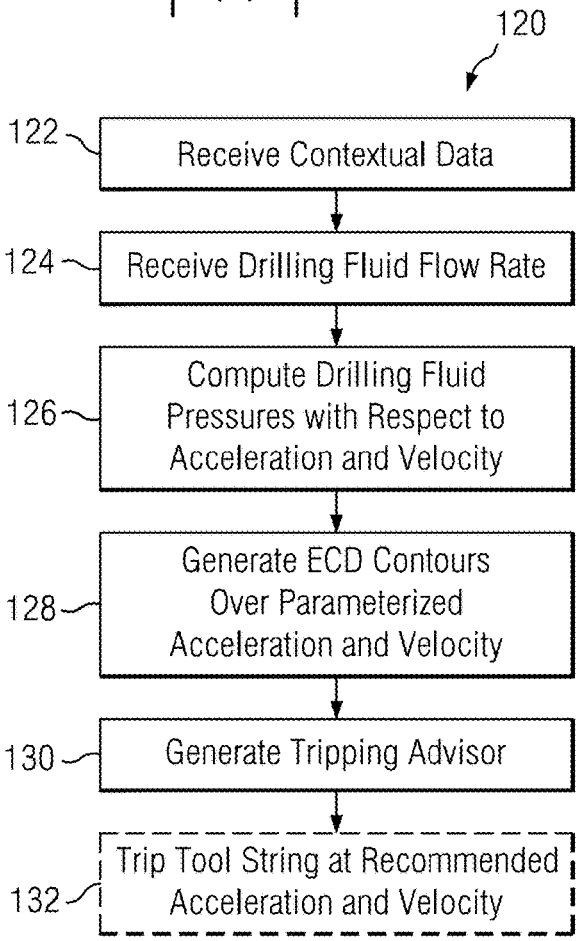
FIG. 4 depicts a flow chart of another example method for advising and/or monitoring a tripping operation.

Turning now to FIG. 4, a flow chart of another example method 120 for monitoring a tripping operation is depicted. Contextual data is received at 122. As described above with respect to FIG. 3, the contextual data may include, for example, wellbore/tool string geometry and drilling fluid rheology data such as the wellbore diameter, diameters of various components in the tool string, drilling fluid viscosity, drilling fluid density, and drilling fluid gel strength. An expected drilling fluid flow rate is also received at 124. The expected drilling fluid flow rate may include, for example, the expected or measured flow rate while tripping a stand or an expected times series flowrate or flow profile while tripping the stand.

At 126 the hydraulics model may be run to compute fluid pressures (and other parameters such as ECD) while tripping the stand at a set of various acceleration and velocity profiles. The model output may be evaluated to generate ECD contours at 128 along a parameterized two-dimensional acceleration and velocity space. The ECD contours may then be evaluated at 130 with formation pore pressures and fracture pressures to generate a tripping advisor board that indicates maximum acceptable velocity and/or acceleration (or a range of acceptable tripping velocities and accelerations).

Figure 5:
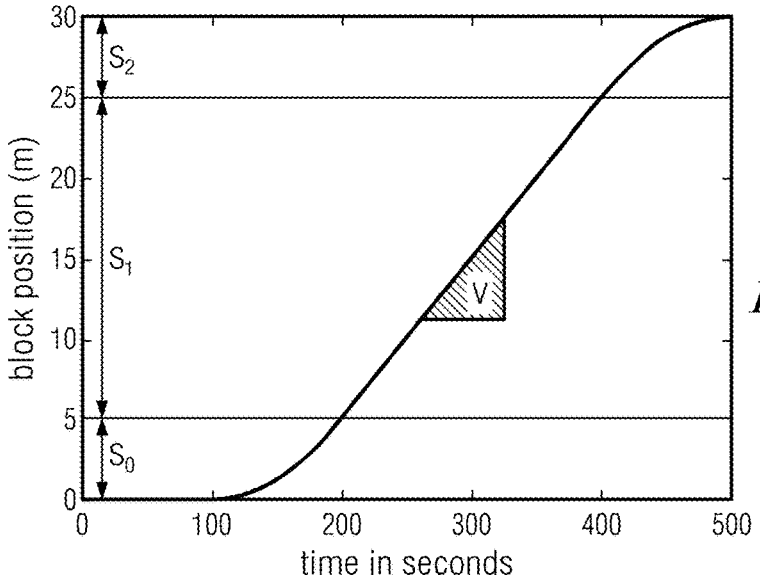
FIG. 5 depicts a plot of traveling block position versus time for a hypothetical tripping operation, showing an acceleration interval, a constant velocity interval, and a deceleration interval.

With continued reference to FIG. 4, in one example embodiment the ECD contours generated at 128 may be contours along a parameterized acceleration length and steady state tripping velocity. With reference to FIG. 5, in example embodiments, the acceleration profile of a stand may be assumed to include an initial acceleration interval followed by an approximately constant velocity interval, and then a deceleration interval. For example, in a common tripping operation the tripping tool string may first be accelerated from zero velocity to an approximate steady state velocity V before decelerating back to zero velocity (at the end of the trip). In the example depicted on FIG. 5, the acceleration and deceleration intervals are labeled $S_0$ and $S_2$ and the constant velocity interval is labeled $S_1$. In certain example embodiments, an acceleration parameter S may be defined such that $S=S_0=S_2$ such that the acceleration parameter defines the acceleration and deceleration distance when tripping a stand (e.g., the change in block position over which the stand is accelerating or decelerating). In such embodiments (and assuming that the acceleration and deceleration is constant from and to an initial velocity of zero), the acceleration parameter S may be expressed in terms of the steady state velocity and acceleration as follows: $S=v^2/2\alpha$ where v represents the steady state velocity and a represents magnitude of the acceleration.

The contours computed at 128 may include, for example, maximum and minimum ECD values while tripping a stand in and/or out of a wellbore. As noted above, in example embodiments, the contours may be generated with respect to an acceleration length (e.g., represented as a fraction of the stand length) and a critical or steady state velocity. Example ECD contours are depicted on FIGS. 6A, 6B, 6C, and 6D (collectively FIG. 6) for drilling fluid flow rates of 0, 500, 1000, and 1500 liters per minute. In this particular example, the ECD contours are in pounds per gallon (where one pound per gallon is equal to about 0.11 kilograms per liter). The ECD contours are depicted with respect to a normalized acceleration parameter S (normalized by the length of the stand) and the steady state velocity (in units of meters per second).

As depicted on FIG. 6, the ECD for Surge 112 and Swab 114 are not symmetric with the lack of symmetry becoming more evident with increasing circulation rates. While not wishing to be bound by theory, it is believed that the lack of symmetry may be explained by the different flow profiles during tripping in and tripping out. While tipping out a void may be created below the tool string that is filled by fluid in the annulus when there is little or no flow. During circulation, the flow may overcome this void depending on the tripping speed and flow rate. While tripping in the flow generally surges in the upward direction so there is often no significant void formation. The change in slope with velocity may be owing to a flow transition from laminar to turbulent regimes.

As noted above with respect to FIG. 4, the ECD contours may be evaluated at 130 along with the formation pore pressures and/or fracture pressures to generate a tripping advisor that indicates maximum advisable velocity and/or acceleration while tripping. It will be appreciated that two important objectives during a tripping operation are often to ensure safety and to minimize the time necessary to trip a stand. It will also be appreciated that these two objectives are often contradictory. For example, minimizing the trip time can increase surge and swab pressures and compromise safety. Likewise maximizing safety by minimizing the surge and/or swab pressures comes at the expense of increased tripping time. Achieving an appropriate balance between safety and tripping time can be a difficult and delicate balance.

Figure 7A:
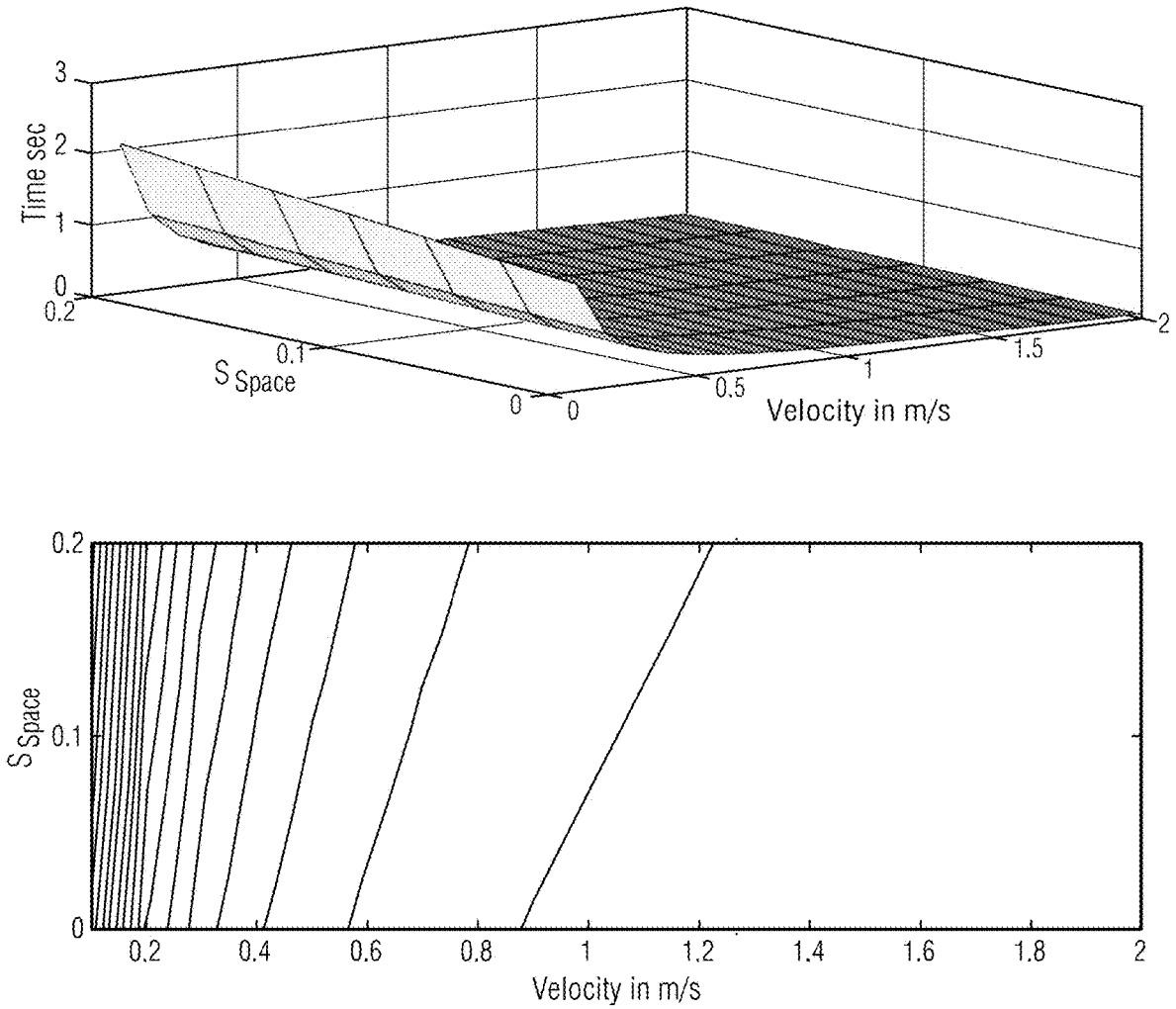
FIGS. 7A and 7B (collectively FIG. 7) depict trip time (7A) and acceleration (7B) contours and corresponding iso time and iso acceleration contour lines.
Figure 7B:
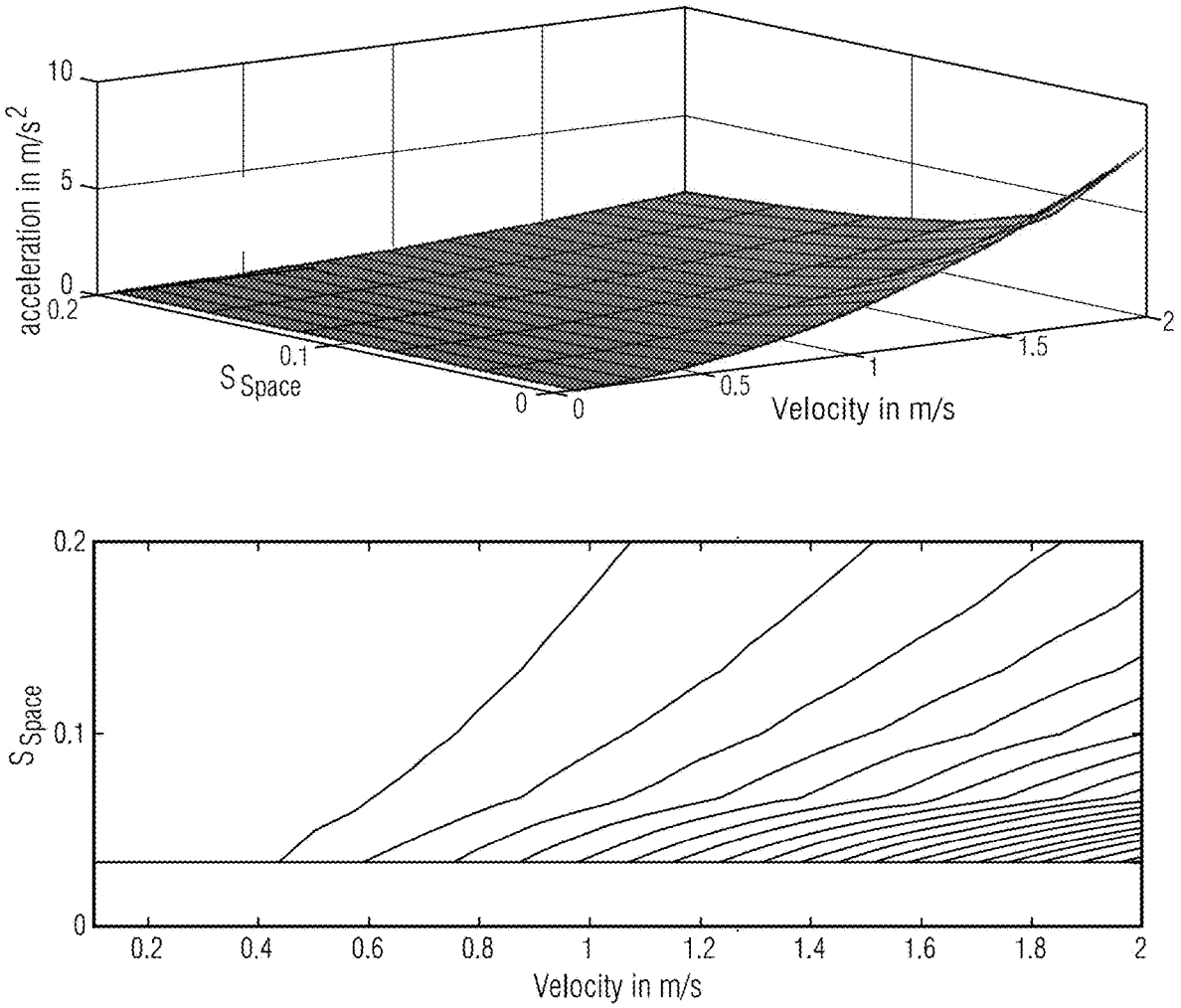

FIGS. 7A and 7B (collectively FIG. 7) depict trip time (7A) and acceleration (7B) contours and corresponding iso time and iso acceleration contour lines plotted with respect to the normalized acceleration parameter S and the steady state velocity.

Figure 8A:
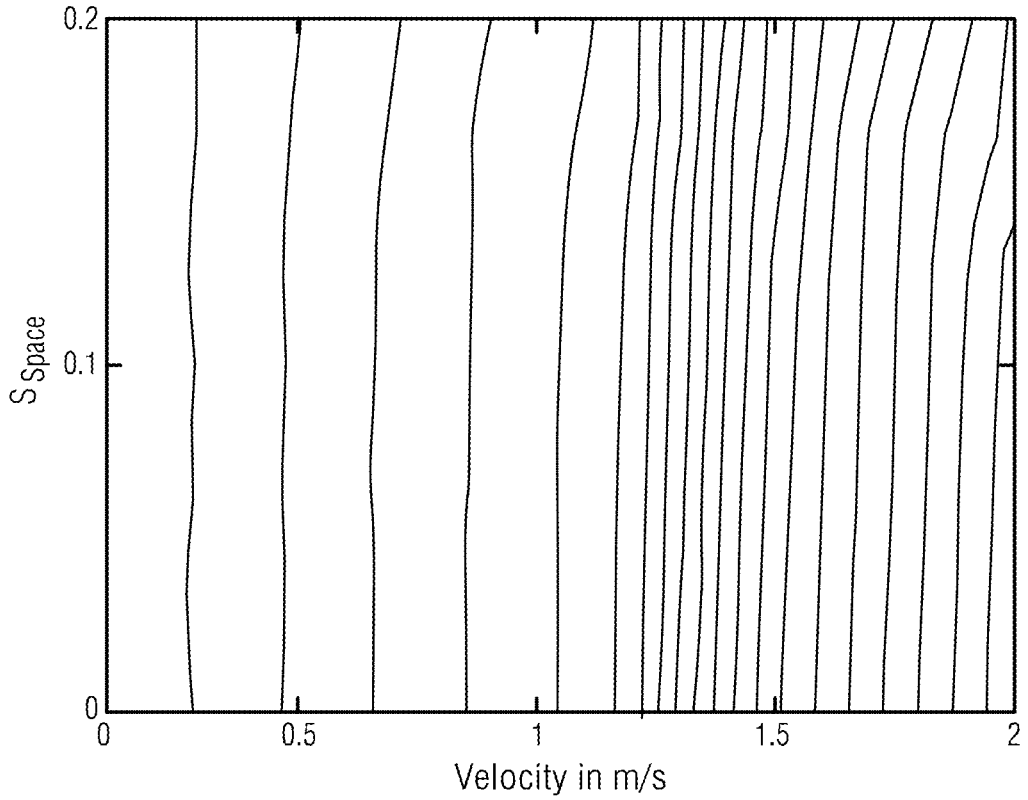
FIGS. 8A and 8B (collectively FIG. 8) depict iso ECD contour lines for surge (8A) and swab (8B) for example tripping operations having a drilling fluid flow rate of 1500 liters/min.
Figure 8B:
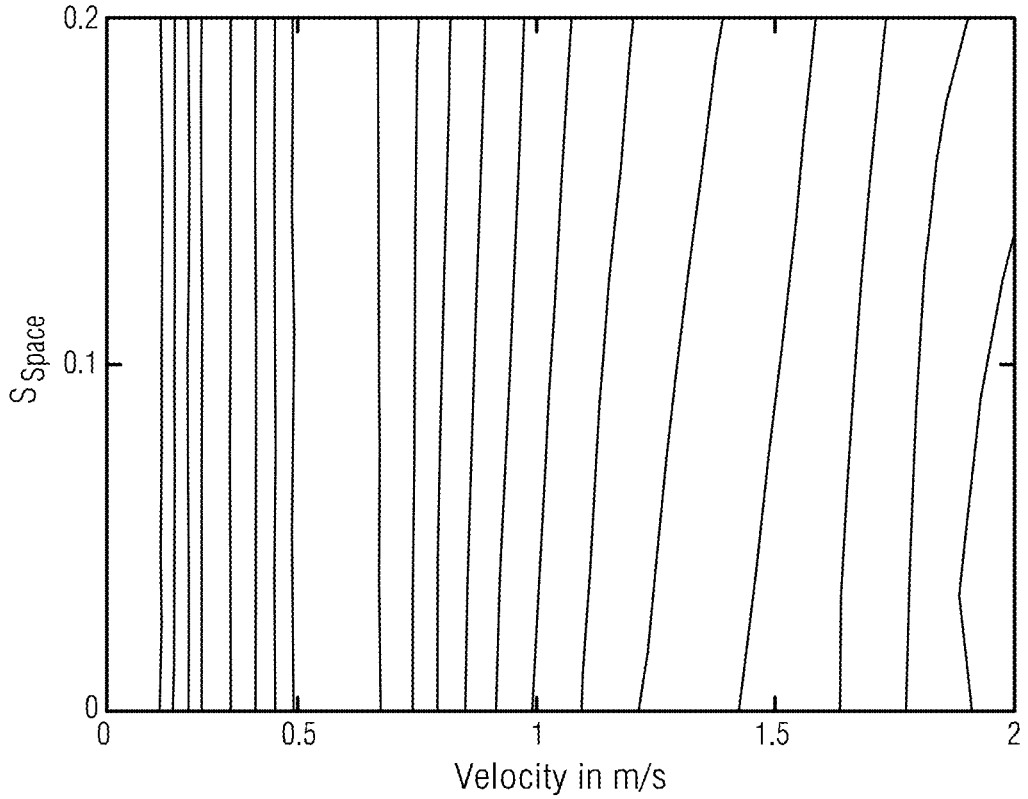

FIGS. 8A and 8B (collectively FIG. 8) depict iso ECD contour lines for surge (8A) and swab (8B) for example tripping operations having a drilling fluid flow rate of 1500 liters/min. In this example, the iso ECD contour lines for both swab and surge are given by vertical lines. Vertical iso ECD contour lines indicate there are minimal acceleration effects. Deviation from the vertical indicates the impact of acceleration on the ECD. In certain tool string configurations, acceleration impacts are primarily observed at steady state velocities above 1 m/s.

Figure 9A:
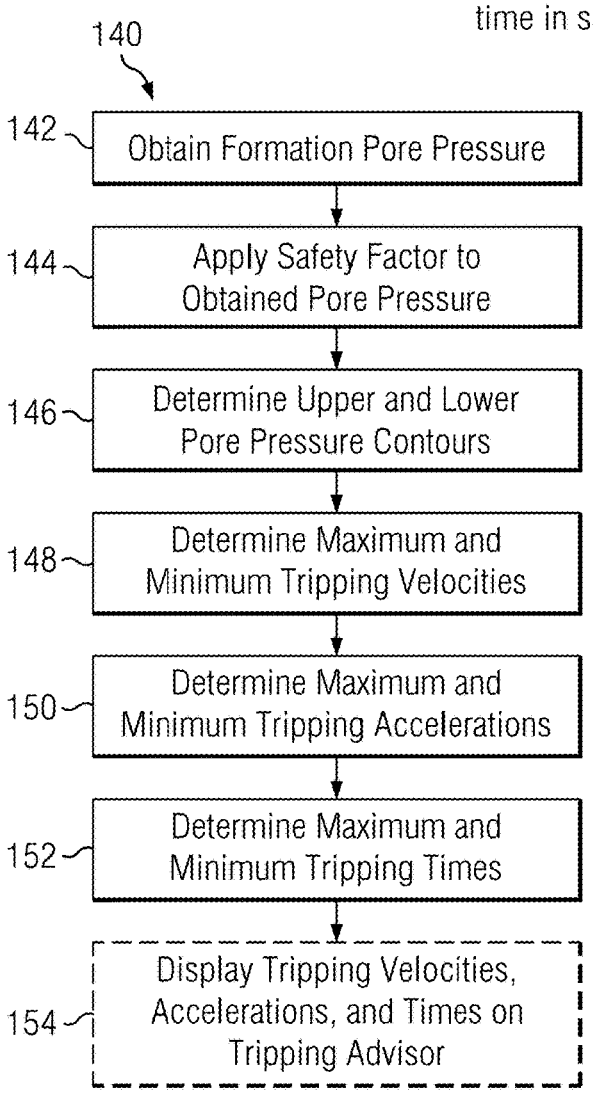
FIGS. 9A and 9B (collectively FIG. 9) depict flowcharts of example methods for evaluating ECD contours for example tripping out (9A) and tripping in (9B) operations.
Figure 9B:
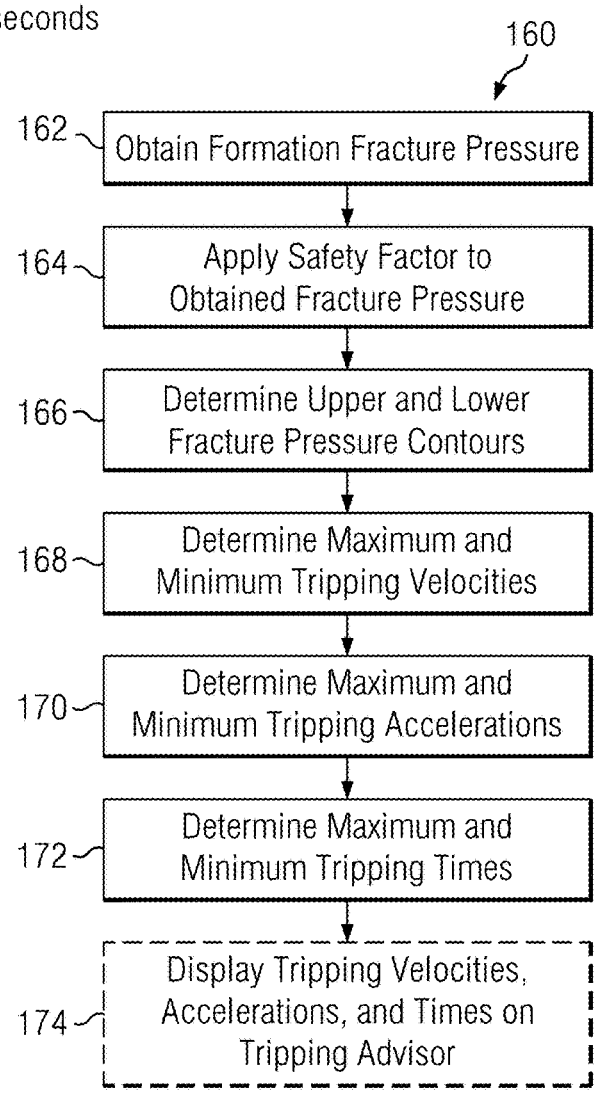
Figure 6A:
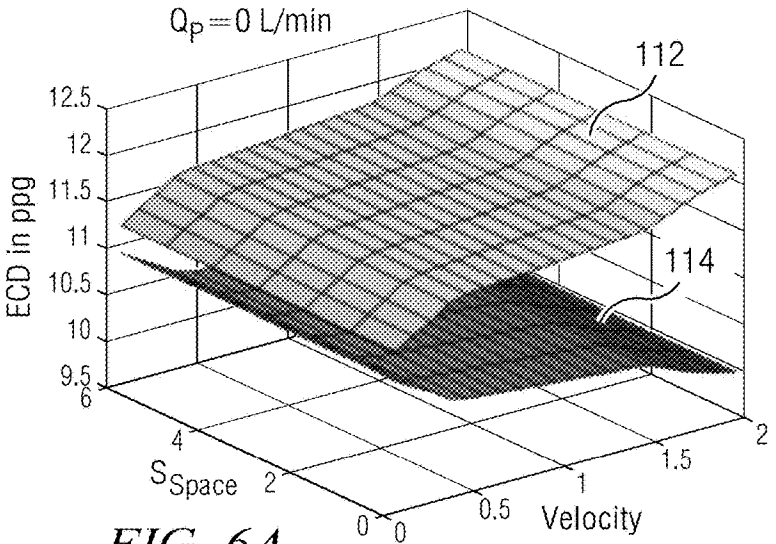
FIGS. 6A, 6B, 6C, and 6D (collectively FIG. 6) depict ECD surge and swab contours for example tripping operations with drilling fluid flow rates of 0, 500, 1000, and 1500 liters per minute.
Figure 6B:
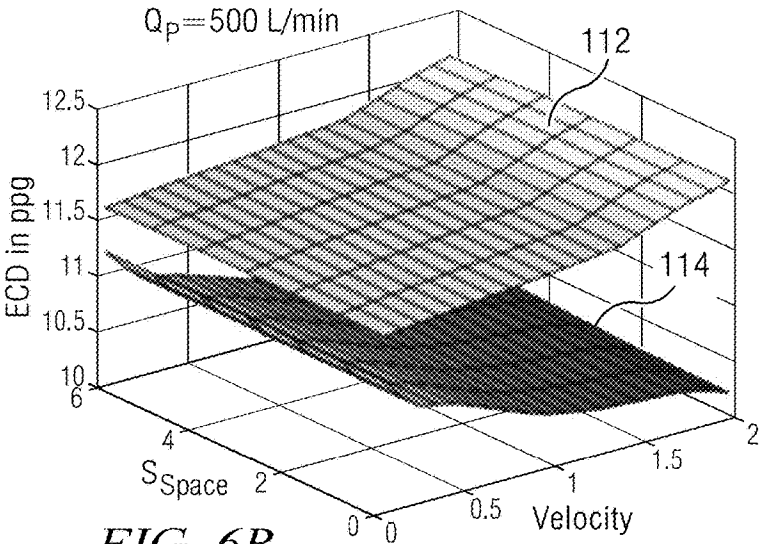
Figure 6C:
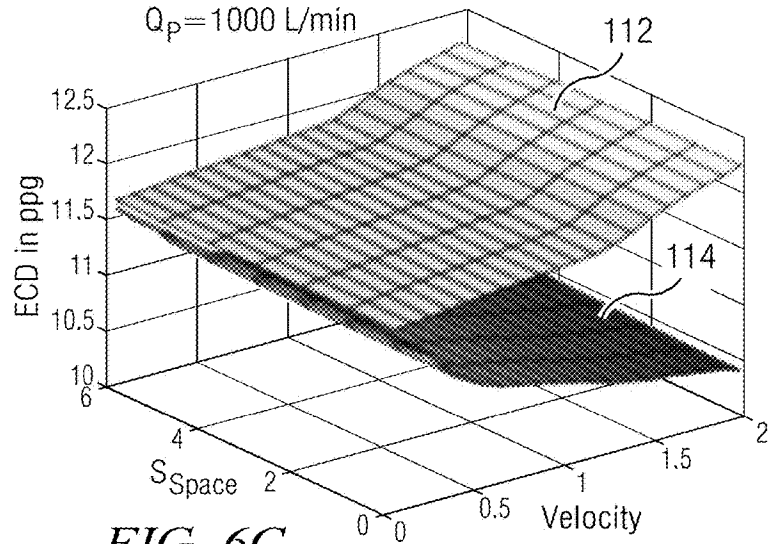
Figure 6D:
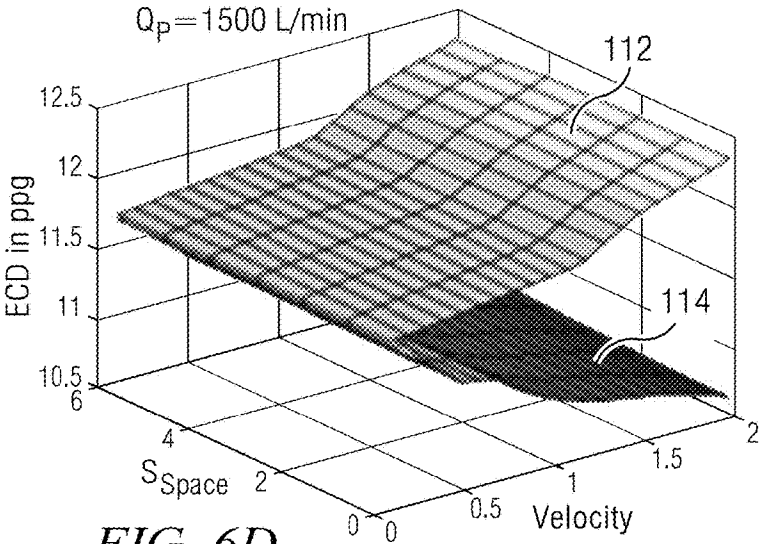

FIGS. 9A and 9B (collectively FIG. 9) depict flowcharts of example methods 140 and 160 for evaluating the ECD contours for tripping out (9A) and tripping in (9B). In FIG. 9A, a formation pore pressure is obtained at 142. The formation pore pressure may be estimated or measured using substantially any suitable techniques known to those of ordinary skill in the art. A safety buffer or factor may be applied to the formation pore pressure to obtain a range of formation pore pressures at 144 including upper and lower pore pressures. Upper and lower pore pressure contours (or contour lines) may be determined with respect to the normalized acceleration parameter S and the steady state velocity at 146 (e.g., plotted along with the iso ECD contour lines shown in FIG. 8). The upper and lower pore pressure contour lines may be evaluated at 148 to determine maximum and minimum velocities for tripping the stand (e.g., a range of velocities that promote both safe and timely tripping). Iso acceleration contour lines may be overlaid with the upper and lower pore pressure contour lines and evaluated at 150 to determine maximum and minimum accelerations for tripping the stand (e.g., a range of accelerations that promote both safe and timely tripping). Iso time contour lines may be optionally overlaid with the upper and lower pore pressure contours and evaluated at 152 to determine maximum and minimum tripping times for the determined velocities and accelerations. The maximum and minimum velocities, accelerations, and optional tripping times may be optionally displayed on a trip advisor board at 154.

In FIG. 9B, a formation fracture pressure may be obtained at 162. The formation fracture pressure may be estimated or measured using substantially any suitable techniques known to those of ordinary skill in the art. A safety buffer may be applied to the received formation fracture pressure to obtain a range of formation fracture pressures at 164 including upper and lower fracture pressures. Upper and lower fracture pressure contour lines may be determined with respect to the normalized acceleration parameter S and the steady state velocity at 166 (e.g., plotted along with the iso ECD contour lines shown in FIG. 8). The upper and lower fracture pressure contour lines may be evaluated at 168 to determine maximum and minimum velocities for tripping the stand (e.g., a range of velocities that promote both safe and timely tripping). Iso acceleration contour lines may be overlaid with the upper and lower fracture pressure contours and evaluated at 170 to determine maximum and minimum accelerations for tripping the stand (e.g., a range of accelerations that promote both safe and timely tripping). Iso time contour lines may be optionally overlaid with the upper and lower fracture pressure contours and evaluated at 172 to determine maximum and minimum tripping times for the determined velocities and accelerations. The maximum and minimum velocities, accelerations, and optional tripping times may be optionally displayed on a trip advisor board at 174.

Figure 10A:
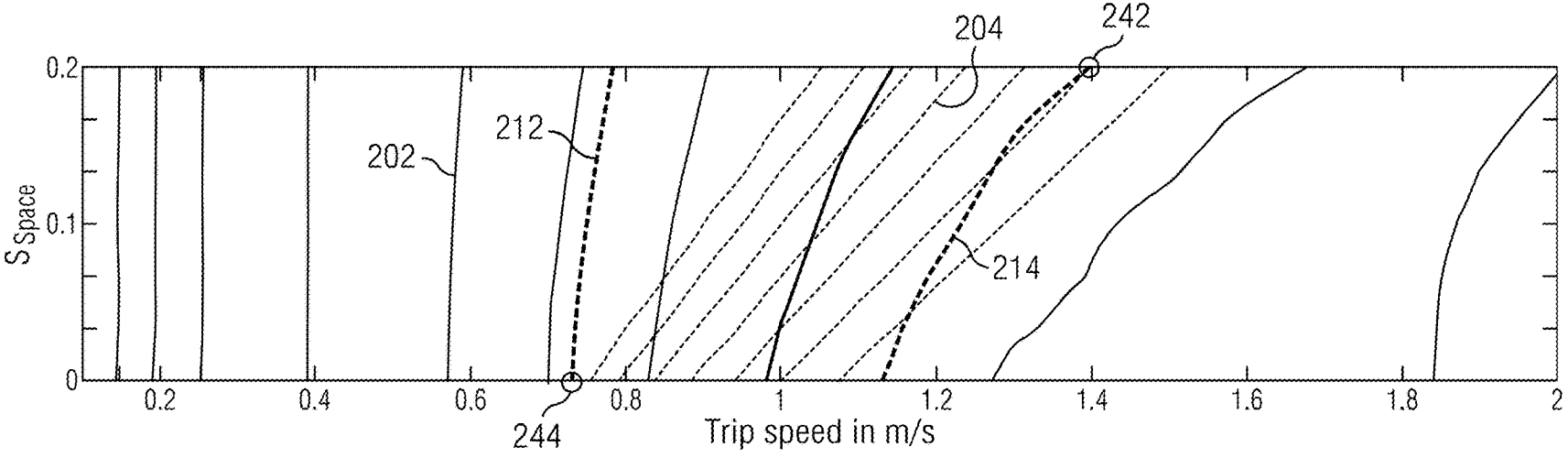
FIGS. 10A and 10B (collectively FIG. 10) depict iso ECD and iso time contour lines (10A) and iso ECD and iso acceleration contour lines (10B) for one example tripping out operation at a drilling fluid flow rate of 500 liters/min.
Figure 10B:
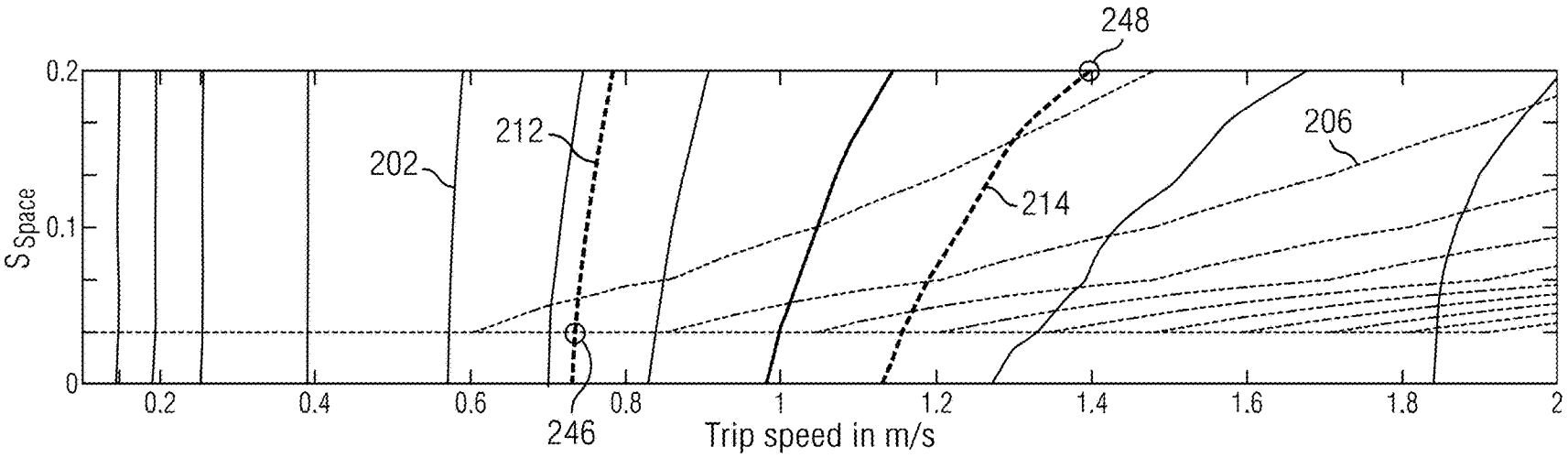
Figure 11A:
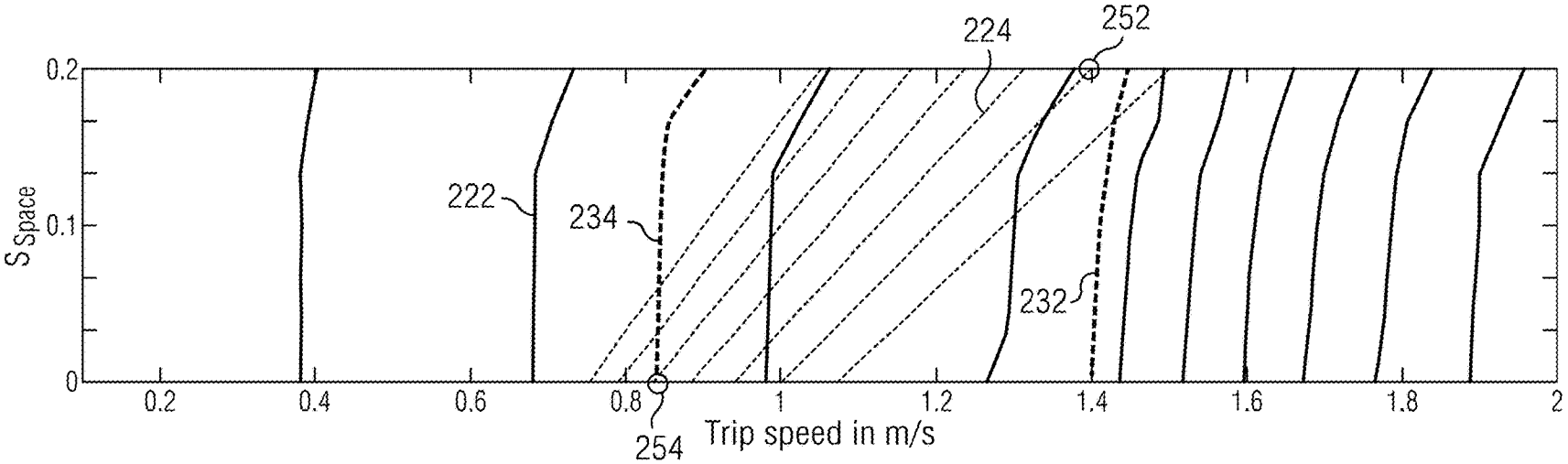
FIGS. 11A and 11B (collectively FIG. 11) depict iso ECD and iso time contour lines (11A) and iso ECD and iso acceleration contour lines (11B) for one example tripping in operation at a drilling fluid flow rate of 500 liters/min.
Figure 11B:
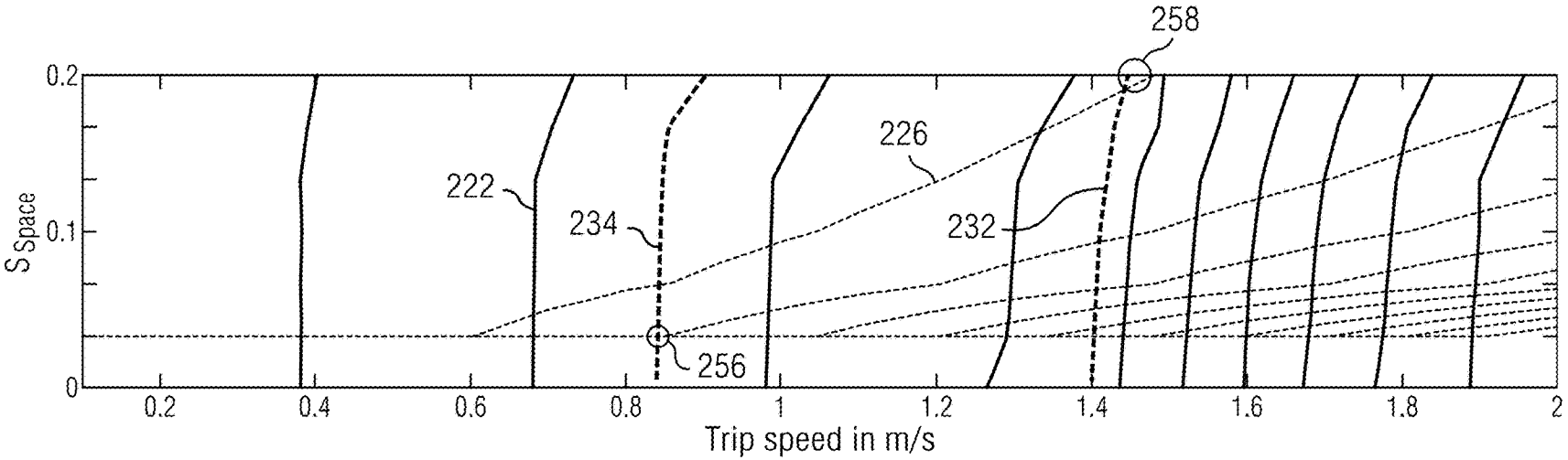

Methods 140 and 160 are now described in more detail by way of the following non-limiting example. FIGS. 10A and 10B (collectively FIG. 10) depict iso ECD 202 and iso time 204 contour lines (10A) and iso ECD 202 and iso acceleration 206 contour lines (10B) for one example tripping out operation at a drilling fluid flow rate of 500 liters/min. Upper and lower formation pore pressure contour lines are also depicted as bold dotted lines at 212 and 214. FIGS. 11A and 11B (collectively FIG. 11) depict iso ECD 222 and iso time 224 contours (11A) and iso ECD 222 and iso acceleration 226 contours (11B) for one example tripping in operation at a drilling fluid flow rate of 500 liters/min. Upper and lower formation fracture pressure contours are also depicted as bold dotted lines 232 and 234.

In FIG. 10A the maximum and minimum velocities for tripping the stand may be determined from the intercepts 242, 244 of the upper and lower pore pressure contours with the velocity (trip speed) axis. The maximum and minimum tripping times may also be determined in FIG. 10A from the intercepts of the upper and lower pore pressure contours with the iso time contours (the intercepts are not shown but occur at about 52 and 27 seconds). In FIG. 10B, the maximum and minimum accelerations while tripping the stand may be determined from the intercepts 246, 248 of the upper and lower pore pressure contours with the iso acceleration contours. Note that the maximum theoretical acceleration is at S=0 (which is essentially infinite acceleration), however, in practice it may be more realistic to select the intercept 246 when S=1.

In FIG. 11A the maximum and minimum velocities for tripping the stand may be determined from the intercepts 252, 254 of the upper and lower fracture pressure contours with the velocity (trip speed) axis. The maximum and minimum tripping times may also be determined in FIG. 11A from the intercepts of the upper and lower fracture pressure contours with the iso time contours (the intercepts are not shown but occur at about 45 and 23 seconds). In FIG. 11B, the maximum and minimum accelerations while tripping the stand may be determined from the intercepts 256, 258 of the upper and lower fracture pressure contours with the iso acceleration contours. Note that the maximum theoretical acceleration is at S=0 (which is an essentially infinite acceleration), however, in practice it may be more realistic to selected the intercept 256 when S=1.

Figure 12A:
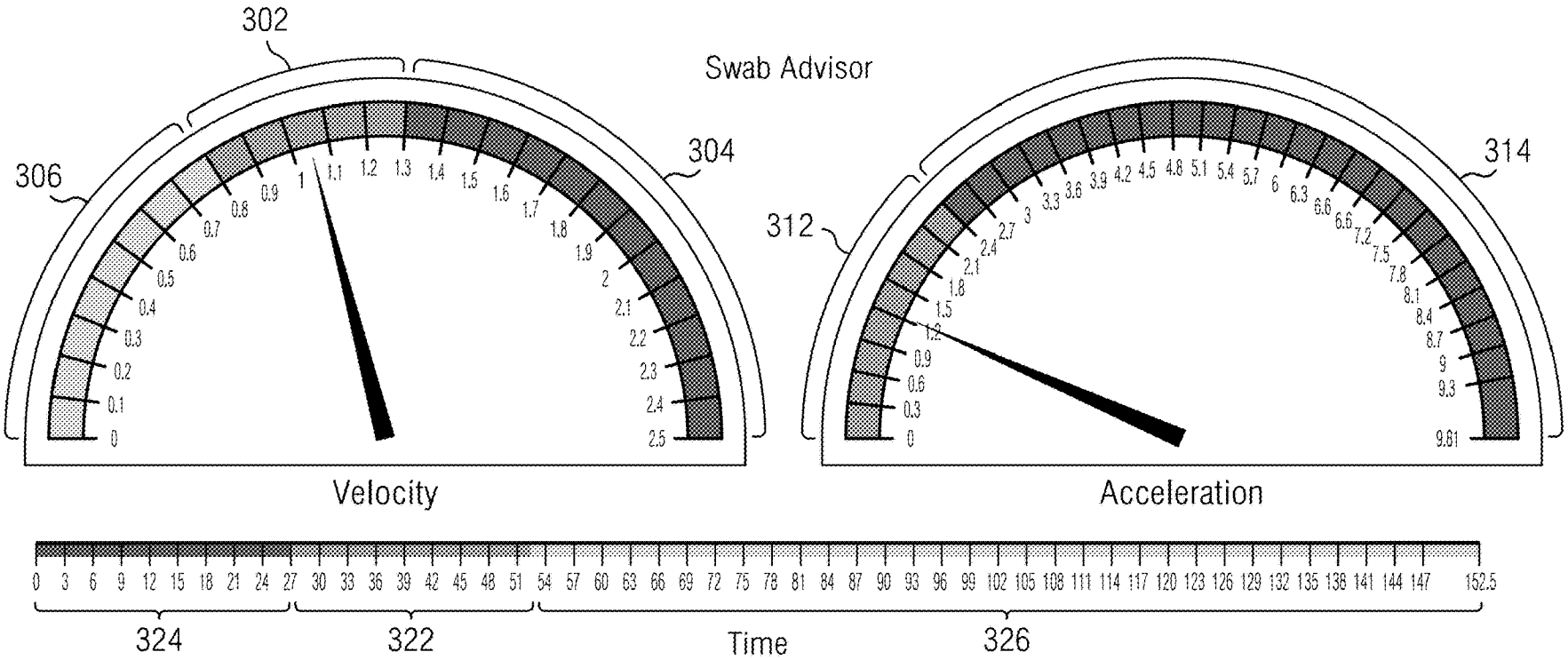
FIGS. 12A and 12B (collectively FIG. 12) depict example swab (12A) and surge (12B) advisors for the example tripping operations described above with respect to FIGS. 10 and 11.
Figure 12B:
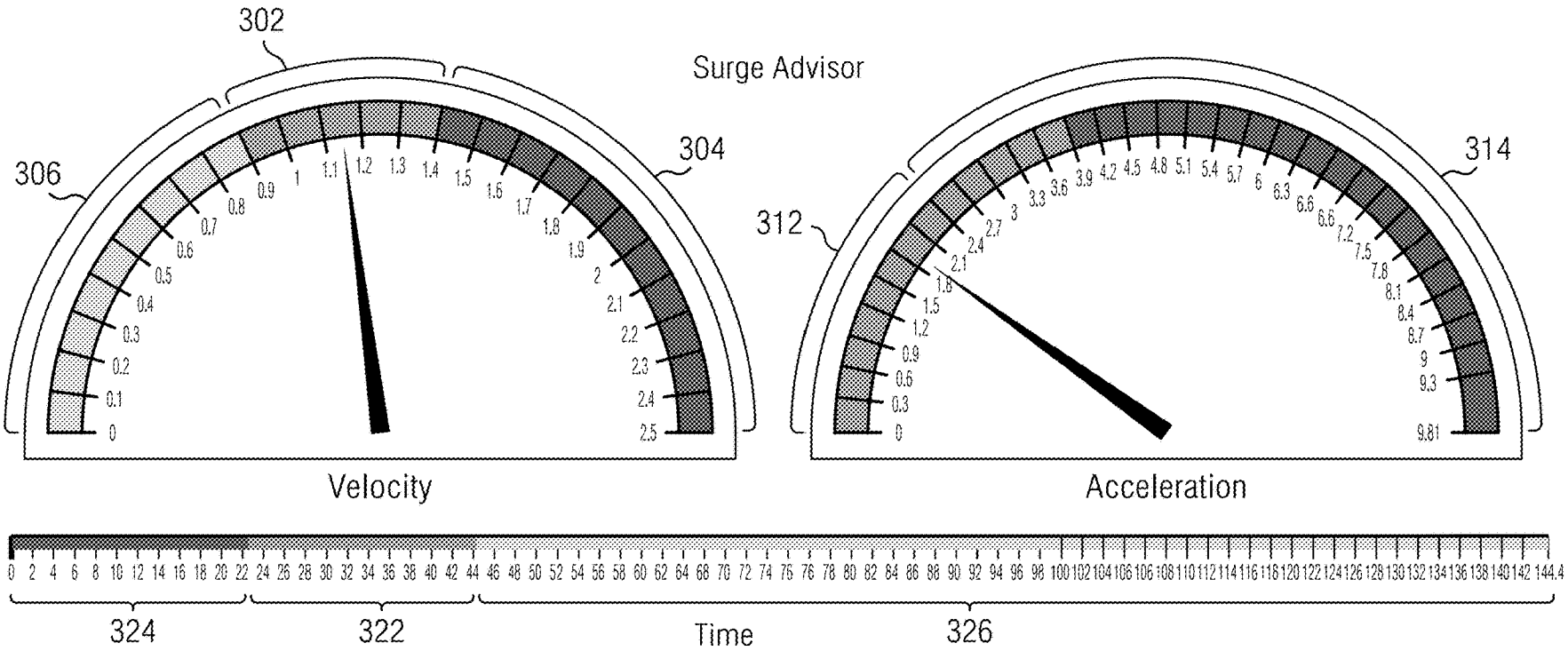

Turning now to FIGS. 12A and 12B (collectively FIG. 12), example swab (12A) and surge (12B) advisors (or speedometers) are depicted for an example flow rate of 500 liters/min from the example described above with respect to FIGS. 10 and 11. In FIGS. 12A and 12B, the example trip advisor includes a visual depiction of the advised trip velocity 302, trip acceleration 312, and trip time 322. The depiction may optionally be pseudo-colored, with the advised trip velocity, trip acceleration, and trip time depicted in green. The trip advisor may also indicate velocities and accelerations above the advised levels 304, 314 as well as trip times below the advised trip time 324. These may be optionally depicted as red indicating a potential safety hazard. The trip advisor may further indicate velocities below the advised levels 306 as well as trip times above advised trip time 326. These may be optionally depicted as yellow or orange indicating a potential slower than necessary trip time. The disclosed embodiments are, of course, not limited to any particular trip advisor configuration or graphical depictions.

It will be understood that the present disclosure includes numerous embodiments. These embodiments include, but are not limited to, the following embodiments.

In a first embodiment, a method for determining a maximum tripping velocity for tripping a downhole tool string in a wellbore includes obtaining contextual data including wellbore data, tool string data, and drilling fluid data; computing downhole drilling fluid pressures at multiple tool string velocities and accelerations using the obtained contextual data and a wellbore hydraulics model; generating an equivalent circulation density (ECD) contour along a two-dimensional acceleration and velocity parameter space from the computed downhole drilling fluid pressures; and evaluating the ECD contour with at least one of a formation pore pressure or a formation fracture pressure to generate the maximum tripping velocity.

A second embodiment may include the first embodiment, wherein the wellbore data comprises a wellbore diameter; the tool string data comprises a tool string diameter and a tool string depth; the drilling fluid data includes a drilling fluid viscosity, a drilling fluid density, and a drilling fluid gel strength.

A third embodiment may include any one of the first through second embodiments, wherein the ECD contour comprises a surge contour and a swab contour.

A fourth embodiment may include any one of the first through third embodiments, wherein the two-dimensional acceleration and velocity parameter space comprises a two dimensional a parameterized acceleration length and steady state tripping velocity that are based on a trip acceleration profile including an initial acceleration interval, a steady state velocity interval, and deceleration interval.

A fifth embodiment may include any one of the first through fourth embodiments, wherein the evaluating the ECD contour further comprises generating a maximum tripping acceleration.

A sixth embodiment may include any one of the first through fifth embodiment, wherein the evaluating the ECD contour further comprises: obtaining a formation pore pressure; applying a safety buffer to the obtained formation pore pressure to obtain upper and lower pore pressures; determining upper and lower pore pressure contours; and determining a minimum tripping out velocity and the maximum tripping out velocity from the upper and lower pore pressure contours.

A seventh embodiment may include the sixth embodiment, further comprising: determining a minimum tripping out acceleration and a maximum tripping out acceleration from intercepts between the upper and lower pore pressure contours and corresponding iso acceleration contours; or determining a minimum tripping out time and a maximum tripping out time from intercepts between the upper and lower pore pressure contours and corresponding iso time contours.

An eighth embodiment may include any one of the first through seventh embodiments, wherein the evaluating the ECD contour further comprises: obtaining a formation fracture pressure; applying a safety buffer to the obtained formation fracture pressure to obtain upper and lower fracture pressures; determining upper and lower fracture pressure contours; and determining a maximum tripping in velocity and a minimum tripping in velocity from the upper and lower pore pressure contours.

A ninth embodiment may include the eighth embodiment, further comprising: determining a maximum tripping in acceleration and a minimum tripping in acceleration from intercepts between the upper and lower pore pressure contours and corresponding iso acceleration contours; or determining a maximum tripping in time and a minimum tripping in time from intercepts between the upper and lower pore pressure contours and corresponding iso time contours.

A tenth embodiment may include any one of the first through ninth embodiments, further comprising displaying the maximum tripping velocity on a trip advisor board.

In an eleventh embodiment a system for tripping a tool string in a wellbore includes a tool string deployed in a wellbore; a processor configured to: receive contextual data including wellbore data, tool string data, and drilling fluid data; compute downhole drilling fluid pressures at multiple tool string velocities and accelerations using the obtained contextual data and a wellbore hydraulics model; generate an equivalent circulation density (ECD) contour along a two-dimensional acceleration and velocity parameter space from the computed downhole drilling fluid pressures; and evaluate the ECD contour with at least one of a formation pore pressure or a formation fracture pressure to generate a maximum velocity for tripping the tool string; and a trip advisor board display configured to display the maximum tripping velocity.

A twelfth embodiment may include the eleventh embodiment, wherein the two-dimensional acceleration and velocity parameter space comprises a two dimensional a parameterized acceleration length and steady state tripping velocity that are based on a trip acceleration profile including an initial acceleration interval, a steady state velocity interval, and deceleration interval.

A thirteenth embodiment may include any one of the eleventh through twelfth embodiments, wherein the evaluate the ECD contour further comprises generate a maximum tripping acceleration.

A fourteenth embodiments may include any one of the eleventh through thirteenth embodiments, wherein the evaluate the ECD contour further comprises: obtain a formation pore pressure; apply a safety buffer to the obtained formation pore pressure to obtain upper and lower pore pressures; determine upper and lower pore pressure contours; and determine a minimum tripping out velocity and the maximum tripping out velocity from the upper and lower pore pressure contours.

A fifteenth embodiment may include any one of the eleventh through fourteenth embodiments, wherein the evaluate the ECD contour further comprises: obtain a formation fracture pressure; apply a safety buffer to the obtained formation fracture pressure to obtain upper and lower fracture pressures; determine upper and lower fracture pressure contours; and determine a maximum tripping in velocity and a minimum tripping in velocity from the upper and lower pore pressure contours.

In a sixteenth embodiment a method for tripping a tool string in a wellbore includes obtaining contextual data including wellbore data, tool string data, and drilling fluid data; computing downhole drilling fluid pressures at multiple tool string velocities and accelerations using the obtained contextual data and a wellbore hydraulics model; generating an equivalent circulation density (ECD) contour along a two-dimensional acceleration and velocity parameter space from the computed downhole drilling fluid pressures; evaluating the ECD contour with at least one of a formation pore pressure or a formation fracture pressure to generate a maximum tripping velocity and a minimum tripping velocity; and tripping the tool string in the wellbore at a velocity between the minimum tripping velocity and the maximum tripping velocity.

A seventeenth embodiment may include the sixteenth embodiment, wherein the two-dimensional acceleration and velocity parameter space comprises a two dimensional a parameterized acceleration length and steady state tripping velocity that are based on a trip acceleration profile including an initial acceleration interval, a steady state velocity interval, and deceleration interval.

An eighteenth embodiment may include any one of the sixteenth through seventeenth embodiments, wherein: the evaluating the ECD contour further comprises generating a maximum tripping acceleration; and the tripping further comprises tripping the tool string in the wellbore at an acceleration that is less than the maximum tripping acceleration.

A nineteenth embodiment may include any one of the sixteenth through eighteenth embodiments, wherein the evaluating the ECD contour further comprises: obtaining a formation pore pressure; applying a safety buffer to the obtained formation pore pressure to obtain upper and lower pore pressures; determining upper and lower pore pressure contours; and determining a minimum tripping out velocity and a maximum tripping out velocity from the upper and lower pore pressure contours.

A twentieth embodiment may include any one of the sixteenth through nineteenth embodiments, wherein the evaluating the ECD contour further comprises: obtaining a formation fracture pressure; applying a safety buffer to the obtained formation fracture pressure to obtain upper and lower fracture pressures; determining upper and lower fracture pressure contours; and determining a maximum tripping in velocity and a minimum tripping in velocity from the upper and lower pore pressure contours.

Although a wellbore tripping advisor has been described in detail, it should be understood that various changes, substitutions and alternations can be made herein without departing from the spirit and scope of the disclosure as defined by the appended claims.

What is claimed is:

1. A method for determining a maximum tripping velocity for tripping a downhole tool string in a wellbore, the method comprising:

obtaining contextual data including wellbore data, tool string data, and drilling fluid data;

computing downhole drilling fluid pressures at multiple tool string velocities and accelerations using the obtained contextual data and a wellbore hydraulics model;

generating an equivalent circulation density (ECD) contour along a two-dimensional acceleration and velocity parameter space from the computed downhole drilling fluid pressures; and evaluating the ECD contour with a formation fracture pressure to generate the maximum tripping velocity, wherein the evaluating the ECD contour further comprises:

obtaining the formation fracture pressure;

applying a safety buffer to the obtained formation fracture pressure to obtain upper and lower fracture pressures;

determining upper and lower fracture pressure contours;

determining a maximum tripping in velocity and a minimum tripping in velocity from the upper and lower fracture pressure contours; and tripping the tool string in the wellbore at a velocity based on the determined maximum tripping in velocity.

2. The method of claim 1, wherein the wellbore data comprises a wellbore diameter;

the tool string data comprises a tool string diameter and a tool string depth;

the drilling fluid data includes a drilling fluid viscosity, a drilling fluid density, and a drilling fluid gel strength.

3. The method of claim 1, wherein the ECD contour comprises a surge contour and a swab contour.

4. The method of claim 1, wherein the two-dimensional acceleration and velocity parameter space comprises a two dimensional parameterized acceleration length and steady state tripping velocity that are based on a trip acceleration profile including an initial acceleration interval, a steady state velocity interval, and a deceleration interval.

5. The method of claim 1, wherein the evaluating the ECD contour further comprises generating a maximum tripping acceleration.

6. The method of claim 1, wherein the evaluating the ECD contour further comprises:

obtaining a formation pore pressure;

applying an additional safety buffer to the obtained formation pore pressure to obtain upper and lower pore pressures;

determining upper and lower pore pressure contours; and determining a minimum tripping out velocity and a maximum tripping out velocity from the upper and lower pore pressure contours.

7. The method of claim 1, further comprising displaying the maximum tripping velocity on a trip advisor board.

8. A system for tripping a tool string in a wellbore; the system comprising:

a tool string deployed in a wellbore;

a processor configured to:

receive contextual data including wellbore data, tool string data, and drilling fluid data;

compute downhole drilling fluid pressures at multiple tool string velocities and accelerations using the received contextual data and a wellbore hydraulics model;

generate an equivalent circulation density (ECD) contour along a two-dimensional acceleration and velocity parameter space from the computed downhole drilling fluid pressures; and evaluate the ECD contour with a formation fracture pressure to generate a maximum velocity for tripping the tool string, wherein the evaluate the ECD contour further comprises:

obtain the formation fracture pressure;

apply a safety buffer to the obtained formation fracture pressure to obtain upper and lower fracture pressures;

determine upper and lower fracture pressure contours; and determine a maximum tripping in velocity and a minimum tripping in velocity from the upper and lower fracture pressure contours; and a trip advisor board display configured to display the maximum tripping velocity; wherein the system trips the tool string in the wellbore at a velocity based on the determined maximum tripping in velocity.

9. The system of claim 8, wherein the two-dimensional acceleration and velocity parameter space comprises a two dimensional parameterized acceleration length and steady state tripping velocity that are based on a trip acceleration profile including an initial acceleration interval, a steady state velocity interval, and deceleration interval.

10. The system of claim 8, wherein the evaluate the ECD contour further comprises generate a maximum tripping acceleration.

11. The system of claim 8, wherein the evaluate the ECD contour further comprises:

obtain a formation pore pressure;

apply an additional safety buffer to the obtained formation pore pressure to obtain upper and lower pore pressures;

determine upper and lower pore pressure contours; and determine a minimum tripping out velocity and a maximum tripping out velocity from the upper and lower pore pressure contours.

12. A method for tripping a tool string in a wellbore, the method comprising:

obtaining contextual data including wellbore data, tool string data, and drilling fluid data;

computing downhole drilling fluid pressures at multiple tool string velocities and accelerations using the obtained contextual data and a wellbore hydraulics model;

generating an equivalent circulation density (ECD) contour along a two-dimensional acceleration and velocity parameter space from the computed downhole drilling fluid pressures;

evaluating the ECD contour with a formation fracture pressure to generate a maximum tripping velocity and a minimum tripping velocity, wherein the evaluating the ECD contour further comprises:

obtaining the formation fracture pressure;

applying a safety buffer to the obtained formation fracture pressure to obtain upper and lower fracture pressures;

determining upper and lower fracture pressure contours; and determining a maximum tripping in velocity and a minimum tripping in velocity from the upper and lower fracture pressure contours; and tripping the tool string in the wellbore at a velocity between the determined minimum tripping in velocity and the determined maximum tripping in velocity.

13. The method of claim 12, wherein the two-dimensional acceleration and velocity parameter space comprises a two dimensional parameterized acceleration length and steady state tripping velocity that are based on a trip acceleration profile including an initial acceleration interval, a steady state velocity interval, and deceleration interval.

14. The method of claim 12, wherein:

the evaluating the ECD contour further comprises generating a maximum tripping acceleration; and the tripping further comprises tripping the tool string in the wellbore at an acceleration that is less than the maximum tripping acceleration.

15. The method of claim 12, wherein the evaluating the ECD contour further comprises:

obtaining a formation pore pressure;

applying an additional safety buffer to the obtained formation pore pressure to obtain upper and lower pore pressures;

determining upper and lower pore pressure contours; and determining a minimum tripping out velocity and a maximum tripping out velocity from the upper and lower pore pressure contours.

* * * * *